United States Patent [19]

Cone

[11] 4,091,987

[45] May 30, 1978

[54] CARRIER SHEET BUSINESS FORM ASSEMBLY

[75] Inventor: Clendon W. Cone, Glens Falls, N.Y.

[73] Assignee: Web Graphics, Inc., Glens Falls, N.Y.

[21] Appl. No.: 726,475

[22] Filed: Sep. 24, 1976

[51] Int. Cl.[2] ..... B65D 27/10

[52] U.S. Cl. ..... 229/69; 221/73; 282/11.5 A

[58] Field of Search ..... 229/69; 282/11.5 R, 282/11.5 A; 221/73

[56] References Cited

U.S. PATENT DOCUMENTS

| | | | |
|---|---|---|---|
| 1,453,616 | 5/1923 | Benenato | 229/69 |
| 2,013,844 | 9/1935 | Sherman | 229/69 |
| 2,028,341 | 1/1936 | Masterson et al. | 229/69 |
| 2,723,077 | 11/1955 | Whitman | 229/69 |
| 2,790,593 | 4/1957 | Reuter | 229/69 |
| 3,208,662 | 9/1965 | Johnson | 229/69 |
| 3,327,927 | 6/1967 | Allison et al. | 229/69 |
| 3,554,447 | 1/1971 | Sebring | 229/69 |
| 3,980,006 | 9/1976 | Welch | 93/61 R |
| 3,987,931 | 10/1976 | Fell et al. | 229/69 |

FOREIGN PATENT DOCUMENTS

| | | | |
|---|---|---|---|
| 689,467 | 6/1964 | Canada | 229/69 |
| 2,430,964 | 6/1975 | Germany | 282/11.5 A |

*Primary Examiner*—Stephen P. Garbe
*Attorney, Agent, or Firm*—Cushman, Darby & Cushman

[57] ABSTRACT

A novel carrier sheet and envelope arrangement comprised of a highly segmented carrier sheet on which envelopes are held in a closed, prefolded condition which allows use of shorter lengths of carrier sheeting for holding comparable qualities of envelopes or other business forms than has heretofore been the case. The carrier sheet and envelope arrangement also allows the envelopes to be removed from the carrier sheet either by hand or automatically by machine.

22 Claims, 5 Drawing Figures

Fig. 1
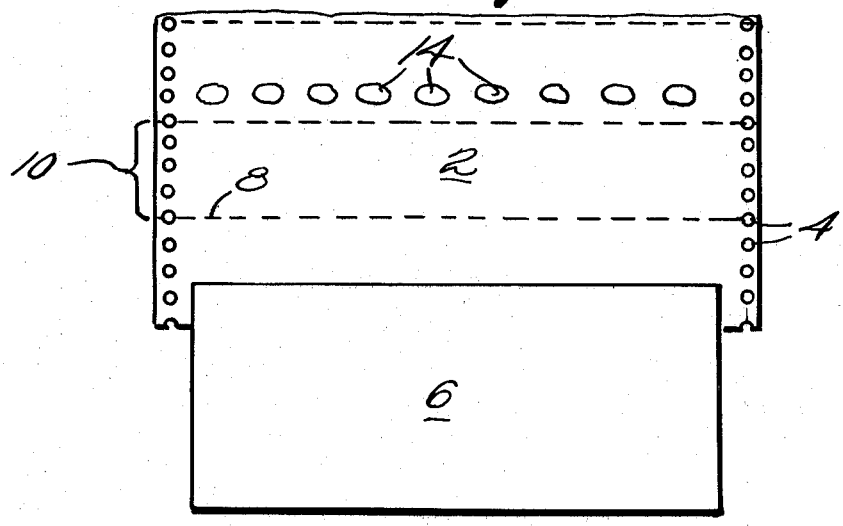
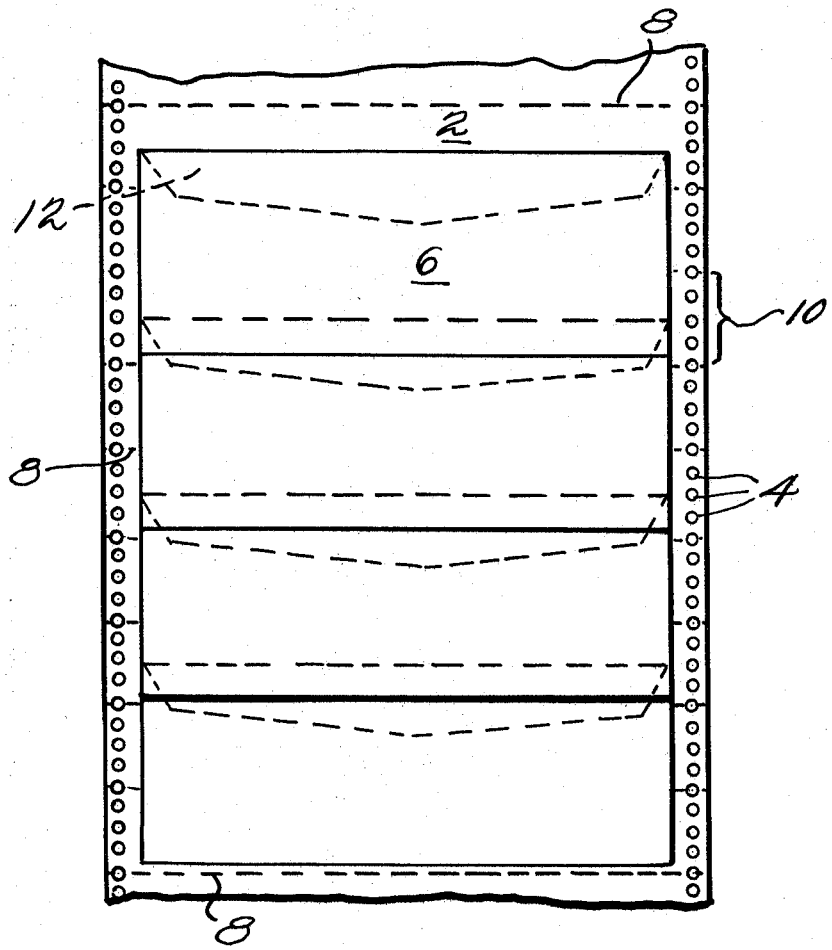
Fig. 2

CARRIER SHEET BUSINESS FORM ASSEMBLY

BACKGROUND OF THE INVENTION

The present invention relates to an arrangement where business forms or envelopes are positioned upon and carried by a continuous carrier sheet. It is often desirable when using word processing equipment such as computer printers, memory typewriters or other automatic typewriters or word processing units to continuously process business forms of a like type. Such business forms can comprise customized unit sets such as purchase orders, voucher checks, multi-page forms, envelopes, letterhead stationary and other such forms.

While it is of course desirable to be able to continuously process a number of such forms and important to properly feed them through the work processing equipment, it is essential that the forms be easily removed or separated from the continuous carrier sheet. Likewise, where envelopes are the forms being processed it is very desirable to not only be able to hand decollate a stack of envelopes from the carrier sheet but that the envelopes be readily removable automatically in decollating equipment. Also it has been found to be desirable to mount envelopes with the flap in a closed or prefolded condition and than when removed from the carrier sheet that the flap remain in that prefolded condition. Thus, if such prefolded envelopes are filled with the contents to be mailed and are removed from the carrier sheet automatically in a decollating or stripping machine, they will already be in condition to be fed to and through a postage machine and be sealed and stamped in a continuous operation.

Further, it has been found to be desirable to work with prefolded envelopes where the sealing flap is already folded over so that the envelopes can be taken off the carrier sheet in an upright fashion while maintaining the folded condition of the envelopes.

Collection of folded envelopes if in an upright position is more easily accomplished and the order in which envelopes are collected is, likewise, more easily controlled. Further, should it become necessary to locate a particular envelope, the label, address or other marking on the envelope is more easily seen if the envelopes are in an upright condition where the flaps have been prefolded and in the order in which they are processed. Finally, prefolded envelopes are ready to have material inserted therein or as previously indicated, if the contents have already been placed in the envelope, each prefolded envelope is ready for sealing and handling in automatic postage equipment and for transfer to such other handling equipment.

Further, prior art carrier sheet-envelope assemblies have been cumbersome to handle and costly for users due to the long length of the carrier sheet. Examples of prior art carrier sheet-envelope assemblies can be found in U.S. Pat. Nos. 2,723,077; 2,790,573; 3,208,662; 3,327,927 and 3,554,447. Also of interest are U.S. Pat. Nos. 1,453,616 and 2,013,844.

As will be more fully explained hereinafter, the length of the carrier sheet in the present invention is segmented but the length of each segment is not equal to the size of the form being supported or carried. In fact, the machine length of each carrier sheet segment is usually less than one-half the machine length of the business form supported thereon. This reduces substantially the amount of carrier sheet required to carry a like amount of business forms, such as envelopes, than has heretofore been the case. In addition, the machine length of the carrier sheet segments and the way the business form is positioned on that segment makes it possible to hand decollate a number of forms quickly and simultaneously. Thus, it should be clearly understood that the term "hand decollation" as contemplated in the present invention does not refer to the process presently used with many known carrier sheet form assemblies where only one form, such as an envelope can be removed at a time. Rather, as will be more fully explained hereinafter, the carrier sheet when folded with the forms in a stacked relationship can be quickly detached from the pile of forms.

A further advantage of employing the improper carrier sheet disclosed herein, is that the shorter segments allow for shorter incremental movements of the forms, such as envelopes, through the word processing equipment. If envelopes were being addressed, a portion of the processing cycle for each envelope includes the movement of the next envelope into its proper initial position. By employing the present carrier sheet, the time required to move the next envelope into its proper start position is reduced. As the number of envelopes being addressed increases, the shorter incremental movement produces substantial savings in processing time.

Other desirable features and objects of the present invention will become more apparent from the following specification when read in conjunction with the accompanying drawings in which the preferred embodiment of the present invention is shown. It should be understood that this preferred embodiment is shown for purposes of illustrating the present invention and is only by way of example.

The drawings comprise:

FIG. 1 is a diagrammatic top plan view of the carrier sheet and envelope assembly in a folded condition where part of the carrier sheet is unfolded;

FIG. 2 is a diagrammatic top plan view of the carrier sheet and envelope in an unfolded condition.

Figure 3:
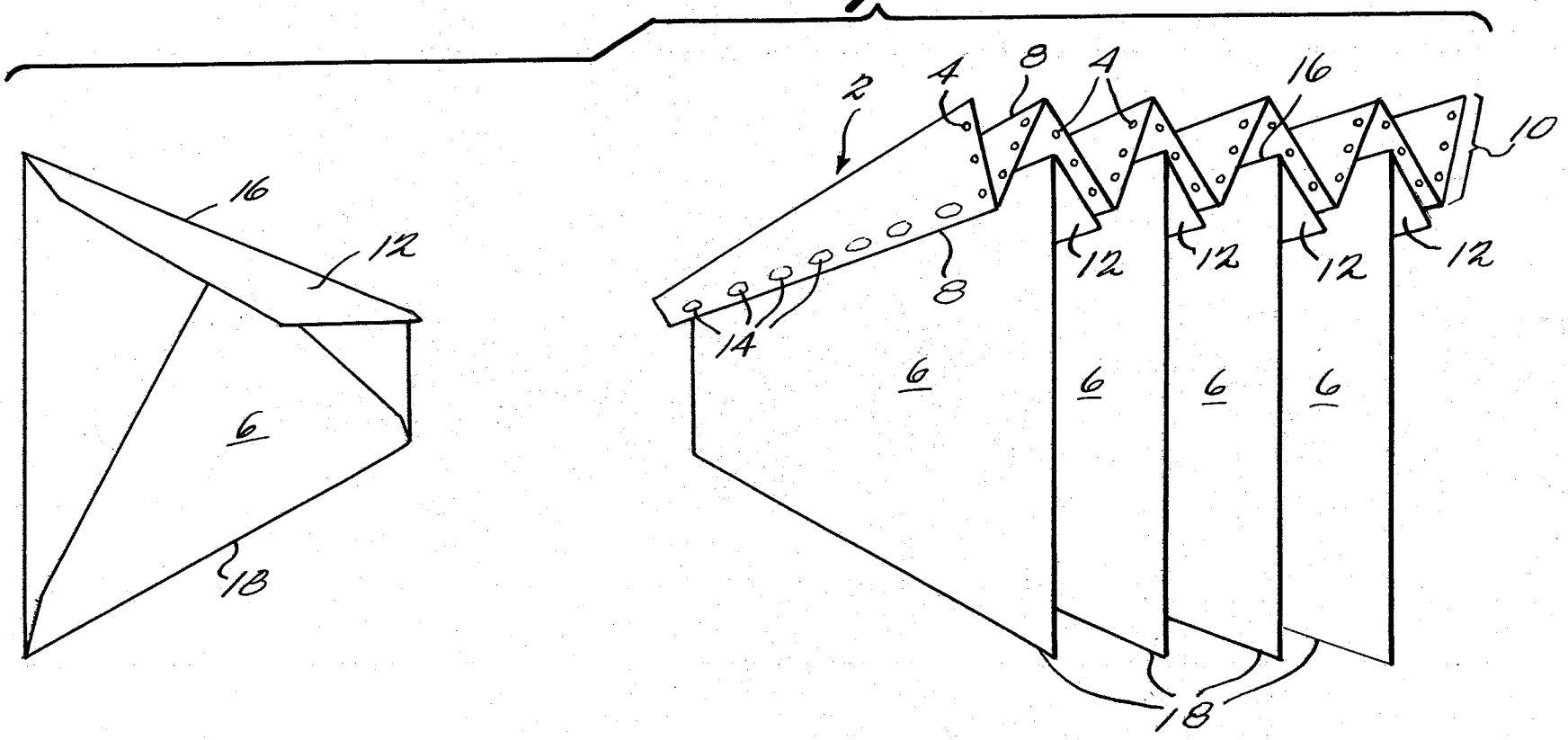
FIG. 3 is a partially exploded perspective view of the carrier sheet and envelope assembly.

Turning now to FIGS. 1–3, carrier sheet 2 is comprised of a continuous sheet of paper having line hole punching 4 longitudinally spaced along each edge which allows the carrier sheet to be transported by pinwheels found on many types of processing apparatus. As shown in FIG. 1, carrier sheet 2 serves to carry envelopes 6 which lie on the carrier sheet 2 in a flat condition. The carrier sheet 2 is slightly wider than envelopes 6 and for example, envelopes 6 would normally be approximately 9½ inches in width while carrier sheet 2 would be about 10⅝ inches in width. Thus, if envelopes 6 were centered on carrier sheet 2, the carrier sheet 2 would extend approximately ½ inch beyond each side of envelopes 6. In order to reduce the length of sheeting necessary to support and move envelopes or other business forms and to make most efficient use of carrier sheet 2, applicant has found that carrier sheet 2 should be highly segmented into a plurality of narrow sections. In particular, carrier sheet 2 is folded in an accordian fashion along weakened lines 8 thereby dividing carrier sheet 2 into a plurality of sections 10. While sections 10 are preferably each about 1½ to 1¾ inches wide, to be most useful, applicant has found that sections 10 should be at least less than half the height of the items held thereon, such as envelopes 6 which are about 4 inches in height so that the segment height is preferably less than one-half or about 40 percent of the height of the envelopes secured thereon.

Lines 8 represent weakened areas extending transversely across carrier sheet 2 and preferably comprise lines of small perforations. Thus, sections 10 can then be folded together in an accordian fashion, as shown in perspective in FIG. 3.

As shown in FIGS. 1–3, envelopes 6 are secured to alternating sections 10 of carrier sheet 2. In particular, the exterior surface of flap 12 of envelope 6 is secured to the lower portion of segments 10 by means of glue spots 14 which are applied just above the line of perforations 8. It is to be understood, however, that glue could equally as well be applied as a line rather than separated spots. Further, the glue could be applied in a pattern and could be shaped to correspond with the shape of the envelope's flap or any other desired shape or pattern. It is preferable to have glue spots 14 lie quite close to the line of perforations 8 so that during either the hand or machine stripping process, should the glue bond be stronger than is desirable so that some of the fibers within carrier sheet in contact with the glue begin to tear, the tear will be terminated by the line of perforations 8. Applicants have found it preferable to secure envelopes 6 on the lower half of segments 10 so that approximately one-half of the surface area of flap 12 lies adjacent or is secured to segment 10. By mounting the envelopes in this manner, one envelope will be positioned on every other section 10 so that the top edge 16 is approximately an inch below the line of perforations 8 located along the top of the assembly, as best shown in FIG. 3.

When the carrier sheet-envelope assembly is in its folded condition, as best shown in FIG. 3, the line of perforations 8 along the top of the assembly will be approximately at the same height as will the position of envelopes 6 in that assembly. Further, the bottoms 18 of envelopes 6 will preferably extend away from carrier sheet 2 a uniform distance and will lie substantially in the same horizontal plane.

Thus, by gluing the exterior surface of flap 12 of the envelope 6 to alternating sections 10 of carrier sheet 2, a carrier sheet and envelope assembly is formed in which the flaps of the envelopes are in a closed condition and the envelopes lie flat. Further, when the carrier sheet 2 is opened up as shown in FIG. 2, while envelopes 6 will overlap each other sufficient room is provided for addressing or labeling the front face of envelopes 6. Also, by having envelopes 6 positioned as described above on carrier sheet 2, the envelopes 6 can be readily stripped from carrier sheet 2 either by hand or automatically by machine. In this regard, while the type of glue or adhesive forming glue spots 14 is important, it is only essential that the glue be sufficiently strong to hold envelopes 6 on carrier sheet 2 for all processing that may be undertaken yet weak enough to allow that bond to be sheared or broken when envelopes 6 are passed through a stripping machine such as the one described in the previously identified co-pending application or when it is desired to hand decollate.

The carrier sheet-envelope assembly described hereinabove provides a way of handling envelopes or other business forms in a fashion that makes them not only easy to handle but, in addition, the envelopes are already folded and are strippable from the carrier sheet in that closed fashion. If envelopes 6 have been already filled with the contents to be mailed, they can be readily addressed in any type of word processing equipment, and are already in a form suitable to be fed to a stamping machine, sealed and mailed. Further, by having envelopes 6 in a closed position, no refolding of flaps 12 is necessary subsequent to stripping. Likewise, even if material is to be inserted into envelopes 6 subsequent to stripping, flap 12 has already been folded and no additional folding step will be necessary prior to sealing or stamping.

By employing a carrier sheet such as is shown at 2, a far shorter amount of carrier sheet is necessary to support a comparable number of envelopes than has previously been the case. Prior art carrier sheets have employed segments at least as wide as the envelopes and thus great lengths of carrier sheet have been required to carry envelopes through word processing equipment. By employing the carrier sheet-envelope assembly as shown and described herein, carrier sheet length is substantially reduced which produced not only savings in paper but also in the expense required to formulate an efficient carrier sheet-envelope assembly.

Figure 4:
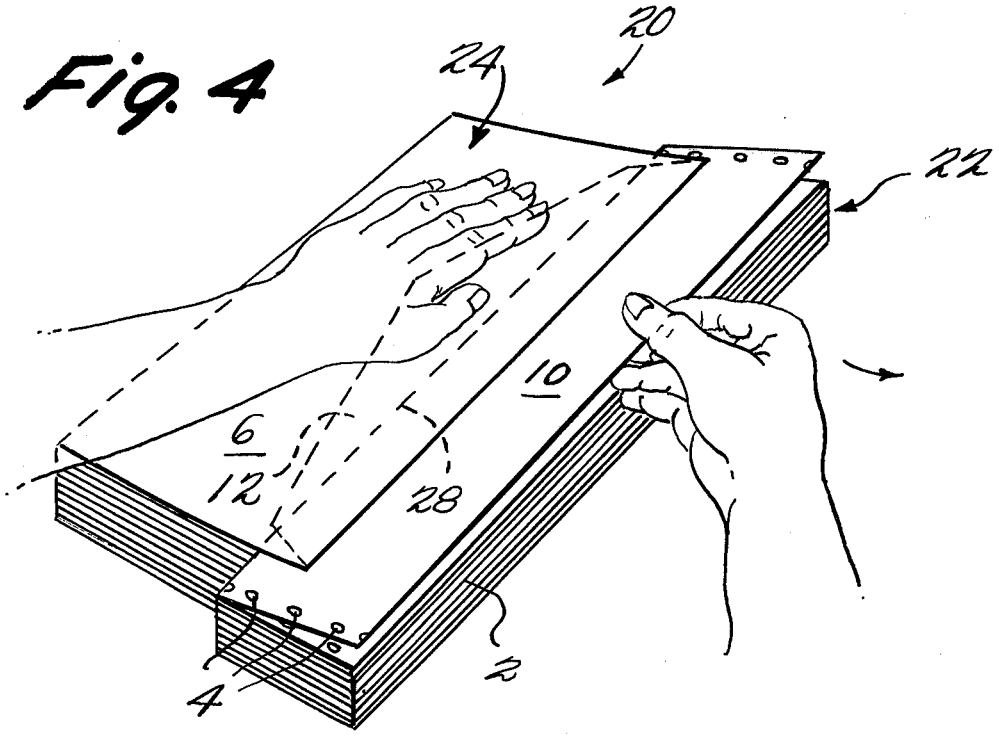
FIG. 4 is a perspective view of a stacked arrangement of the carrier sheet/envelope assembly prior to being hand decollated.
Figure 5:
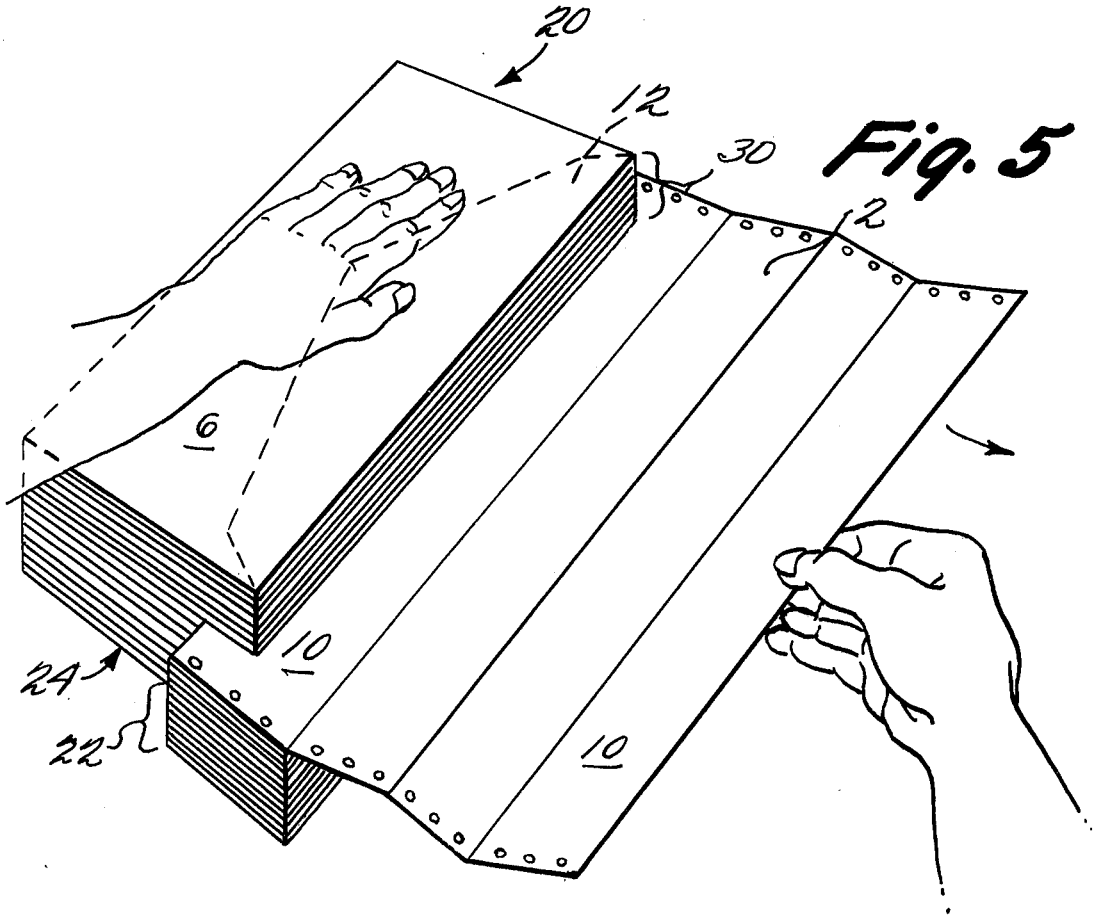
FIG. 5 is a perspective view of a stacked arrangement of the carrier sheet/envelope assembly which has been partially hand decollated.

Turning now to FIGS. 4 and 5, the hand decollating process contemplated herein can be clearly understood. As shown in FIG. 4, the carrier sheet 2 with envelopes 6 attached thereto to is folded along weakened lines 8 and is formed into a stacked or piled assembly generally indicated at 20. The folded carrier sheet is generally indicated at 22 while the piled envelopes are generally indicated at 24. The top envelope islying face up so that the flap 12 is underneath and is shown by phantom line 26. Likewise, a portion of the top segment 10 of carrier sheet 2 is located beneath the top envelope and its position is shown in phantom by line 28. When stacked in this manner, a portion of flap 12 will extend away from the folded carrier sheet 22 and it is, therefore, possible to place downward pressure on the pile of envelopes 24 and on that portion of flap 12 without also placing downward pressure on the folded carrier sheet 22. As shown in FIG. 4, the pressure on the stack of envelopes 24 is applied by the hand resting thereon.

To hand decollate it is only necessary, then, to place pressure on the stacked envelopes 24 and a portion of flap 12 as just described. Thereafter, the top segment 10 of the folded carrier sheet 22 is grasped and easily pulled out and away from the stack of envelopes 24 in the direction shown by the arrow as has been partially done in FIG. 5.

In FIG. 5, the carrier sheet 2 has been stripped away from an upper portion of the stack of envelopes generally indicated at 30 while the remaining lower portion of the stack of envelopes 24 remain to be separated from the carrier sheet 2. If the pulling of the carrier sheet 2 were continued in the direction of the arrow the remaining length of carrier sheet and envelopes would be easily separated leaving a stack of envelopes in the order in which they were labeled, addressed, or otherwise processed and the length of unfolded carrier sheet.

Thus, the present carrier sheet/envelope assembly allows for quick and easy separation of envelopes from a carrier sheet and allows an entire stack of envelopes to be hand decollated while in order and in a stacked condition.

It will now be clear that there is provided herein a unique carrier sheet-envelope assembly which accomplishes the objectives heretofore set forth. While the invention has been disclosed in its preferred exemplary form, it is to be well understood that the specific embodiment as described and illustrated herein is not to be considered in a limited sense and there may well be other forms or modifications of this preferred embodiment which should also be construed as coming within the scope of the appending claims.

What is claimed is:

1. An improved carrier sheet and envelope assembly comprising a continuous carrier sheet having a plurality of transversely extending longitudinally spaced-apart weakened lines, said weakened lines serving to divide said carrier sheet into a plurality of transversely extending sections, each of said sections having a length defined by the spacing between adjacent ones of said weakened lines, a plurality of envelopes each of said envelopes having a sealing flap in a closed, folded condition, means for detachably securing said envelopes to a lower portion of alternating ones of said carrier sheet segments so that only about one half of the closed flap is positioned on said segment with the remaining portion of the flap extending away from said segment thereby allowing the carrier sheet to be folded in a zig-zag fashion thereby positioning the envelopes in an aligned, stacked condition with each envelope positioned directly beneath the envelpe thereabove with each envelope having its front face being adjacent the rear face of the envelope thereabove whereby the remaining portion of the flap is positioned outwardly of the stack of folded segments and about one half of the width of the stack of folded segments extends outwardly from the stack of envelopes.

2. An improved carrier sheet and envelope assembly as in claim 1, wherein said weakened lines comprise lines of perforations.

3. A flat pack comprised of a combination of a plurality of envelopes each having a folded flap and a continuous carrier sheet having a plurality of transversely extending, longitudinally spaced-apart lines of perforations serving to divide said carrier sheet into a plurality of segments, said envelopes being positioned on alternating ones of said plurality of carrier sheet segments so that only about one half of the closed flap of said envelopes is in registry with and removably secured to the alternating ones of said carrier sheet segments.

4. An envelope assembly as in claim 3 wherein the side of said sheet extends outwardly beyond each of said envelopes secured thereto and wherein each side of said sheet extending beyond said envelopes is provided with means defining a plurality of longitudinally spaced apertures.

5. An envelope assembly as in claim 3 wherein each of said plurality of segments has an upper and a lower portion.

6. An envelope assembly as in claim 5 wherein each of said envelopes is detachably secured by adhesive, said adhesive being transversely spaced across at least a portion of said segment and positioned in the lower portion adjacent the line of perforations in the lower portion.

7. A flat pack as in claim 6 wherein said adhesive is in the form of a plurality of spaced-apart individual spots of adhesive.

8. A flat pack as in claim 6 wherein said carrier sheet segments have a width of about $1\frac{3}{4}$ inches.

9. An envelope assembly as in claim 3 wherein the ratio between the height of each of said segments and the height of said envelopes is about 1 to 2.5.

10. A flat pack as set forth in claim 3 wherein the length of each segment is at least less than one half the length of each envelope and wherein the carrier sheet is in an unfolded condition whereby the envelopes are positioned in an overlapping relationship with the top edge being positioned beneath the preceding envelope and with a predetermined portion of each envelope exposed below the preceding envelope thereby allowing sufficient room for each envelope to be properly addressed.

11. A flat pack as in claim 3 wherein the carrier sheet is folded in a zig-zag fashion so as to position envelopes secured thereto in an aligned, stacked condition with each envelope being positioned directly beneath the envelope thereabove such that each envelope faces in the same direction and where said plurality of carrier sheet segments are also in an aligned stacked condition with that portion of the flap on each of said plurality of envelopes not in registry with the carrier sheet segments being positioned outwardly of the stack of aligned carrier sheet segments.

12. A flat pack as in claim 3 wherein the width of said carrier sheet segments ranges between about one and one half inches to about $1\frac{3}{4}$ inches.

13. A flat pack comprised of a combination of envelopes having folded flaps and a continuous carrier sheet having a plurality of transversely extending longitudinally spaced-apart lines of perforations serving to divide said carrier sheet into a plurality of segments, each of said segments having a width at least less than one half the width of the envelopes positioned thereon the width thereof being divided into an upper portion and a lower portion, said envelopes being removably secured to the lower portion of alternating ones of said carrier sheet segments so that the flaps of said envelopes remain folded.

14. A flat pack as in claim 13 wherein the width of said carrier sheet segments ranges between about $1\frac{1}{2}$ inches to about $1\frac{3}{4}$ inches.

15. A flat pack as in claim 13 wherein said carrier sheet segments have a width of about $1\frac{3}{4}$ inches.

16. A flat pack as in claim 13 wherein each of said envelopes is detachably secured by adhesive, said adhesive being transversely spaced across at least a portion of said segment and positioned in the lower portion adjacent the line of perforations in the lower portion.

17. A flat pack as in claim 16 wherein said adhesive is in the form of a plurality of spaced-apart individual spots of adhesive.

18. A flat pack as in claim 16 wherein said adhesive is in the form of a line.

19. A flat pack as in claim 16 wherein said adhesive is in the form of a shaped pattern corresponding to the shape of the envelope flap positioned on said segment.

20. A flat pack as in claim 13 wherein about one half of the surface of the flap of said envelopes is secured to said segments.

21. A flat pack comprised of a combination of envelopes having folded flaps and a continuous carrier sheet having a plurality of transversely extending longitudinally spaced-apart lines of perforations serving to divide said carrier sheet into a plurality of segments, each of said segments having a width less than one half of the width of the envelopes positioned thereon with the width of said segments being divided into an upper portion and a lower portion, said envelopes being removably secured to alternating ones of said carrier sheet segments by securing a predetermined portion of the folded flap of each of said envelope to the lower portion of said alternating segments.

22. An improved business form system comprised of the combination of a continuous carrier sheet and a plurality of business forms removably attached to said carrier sheet, said continuous carrier sheet having a plurality of transversely extending longitudinally spaced-apart lines of perforations dividing said carrier sheet into a plurality of transversely extending sections, each of said sections having a width defined by said lines of perforations with the width thereof having an upper and lower portion, means provided transversely along the lower portion of alternating segments for detachably securing each of said plurality of business forms to said lower portion of such alternating ones of said carrier sheet segments so that when the carrier sheet is folded in a zig-zag fashion said plurality of business forms are positioned in an aligned, stacked condition with each of said forms facing in the same direction and being positioned directly beneath the form thereabove and wherein said carrier sheet segments are also placed in a stacked, aligned condition with about one half of the width of the stack of folded carrier sheet segments extending outwardly from the stack formed of said plurality of business forms.

* * * * *